US005364287A

United States Patent [19]

Weber

[11] Patent Number: 5,364,287

[45] Date of Patent: Nov. 15, 1994

[54] CONNECTOR RESTRAINING APPARATUS

[75] Inventor: William F. Weber, Allen, Tex.

[73] Assignee: Alcatel Network Systems, Inc., Richardson, Tex.

[21] Appl. No.: 88,158

[22] Filed: Jul. 7, 1993

[51] Int. Cl.[5] ..... H01R 13/627

[52] U.S. Cl. ..... 439/358; 439/372

[58] Field of Search ..... 439/345, 350, 352, 357, 439/358, 366, 370, 372

[56] References Cited

U.S. PATENT DOCUMENTS 3,164,750 1/1965 Miller ..... 439/355 X

FOREIGN PATENT DOCUMENTS 0040875 2/1990 Japan ..... 439/358

OTHER PUBLICATIONS

IBM Technical Bulletin, vol. 30, No. 12, May 1988, "Connector Latch", p. 82.

*Primary Examiner*—Khiem Nguyen

*Attorney, Agent, or Firm*—Vinson & Elkins L.L.P.

[57] ABSTRACT

An easily attached and detached locking mechanism is provided to prevent accidental disconnection between mounted and removable connector elements. The mechanism comprises interconnected and tensioned arms with tangs that enclose the connector elements with the interconnection and the tangs providing forces in opposite directions to maintain the connector elements in contact. Inward forces, on the ends of the tensioned arms opposite the tangs, increase the distance between the tangs for attachment of or removal from the connectors to be locked together.

8 Claims, 1 Drawing Sheet

CONNECTOR RESTRAINING APPARATUS

THE INVENTION

The present invention relates generally to connectors and more specifically to a connector restraining apparatus for preventing accidental disengagement of two mating or complementary connector elements.

BACKGROUND

There are many situations where removable electrical connectors can be accidentally bumped or otherwise displaced from positive electrical connection with their complementary mounted connector contacts. Many connectors include screw-type lock down devices which provide the locking engagement between male and female connector elements (removable and mounted connectors).

There are times, however, when the design of one of the complementary connector elements is such that presently available and conventional techniques for locking the complementary parts together cannot be used. Even when present day techniques are used, the time necessary to screw the mating parts together and unscrew them when disconnection is desired, can be irritating.

One prior art solution to the locking of a ribbon cable removable connector to the mounted compatible connector uses a sliding locking mechanism which is incompatible with known EMI solutions. Such a sliding-/locking mechanism has been found to be difficult to operate and extremely hard to use when there is a crowded backplane.

A specific situation arises in connection with the use of a 50 pin subminiature D backplane or mounted connector that in some instances may be connected to a grounded EMI/RFI shielded removable connector in situations which require EMI/RFI shielding, and in other situations, may be connected to a non-shielded ribbon cable connector. While parts are available, "off the shelf", to connect the grounded connector to the backplane connector, the width of a ribbon cable connector and the design of such, makes the application of positive locking screws on the removable portion of the complementary connector parts, a physical impossibility.

SUMMARY OF THE INVENTION

The present invention comprises a retaining clip which exerts opposing forces on the cover of the removable connector and on the backside of opposing ends of the mounted connector using inwardly biased hinged tangs or lever action spring-loaded tangs which are designed in such a manner that they can be easily engaged or disengaged from the complementary connector elements to place them in a locked or unlocked condition.

DESCRIPTION OF THE DRAWINGS

It is therefore an object of the present invention to provide an improved connector disengagement restraining device.

Other objects and advantages of the present invention will be apparent from a review of the specification and appended claims in conjunction with the drawings wherein:

DETAILED DESCRIPTION

Figure 1:
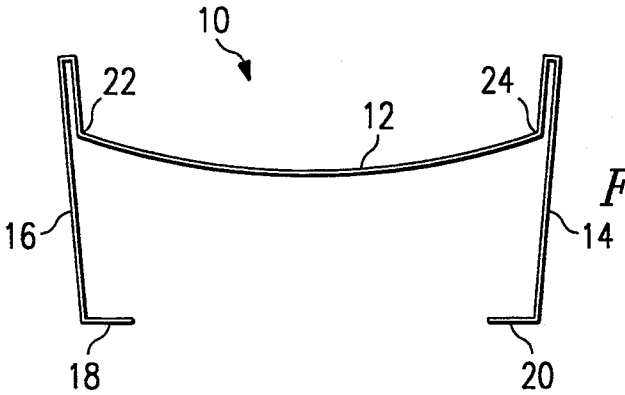
FIG. 1 is a side view of the connector restraining apparatus.

In FIG. 1 a connector restraining or securing device generally designated as 10 comprises a first force applying member or cover pressure device 12 interconnecting tanged levers or clamp members attached thereto having legs 14 and 16, left and right tangs 18 and 20, respectively, and pivotally attached to member 12 at points 22 and 24 as illustrated.

Figure 2:
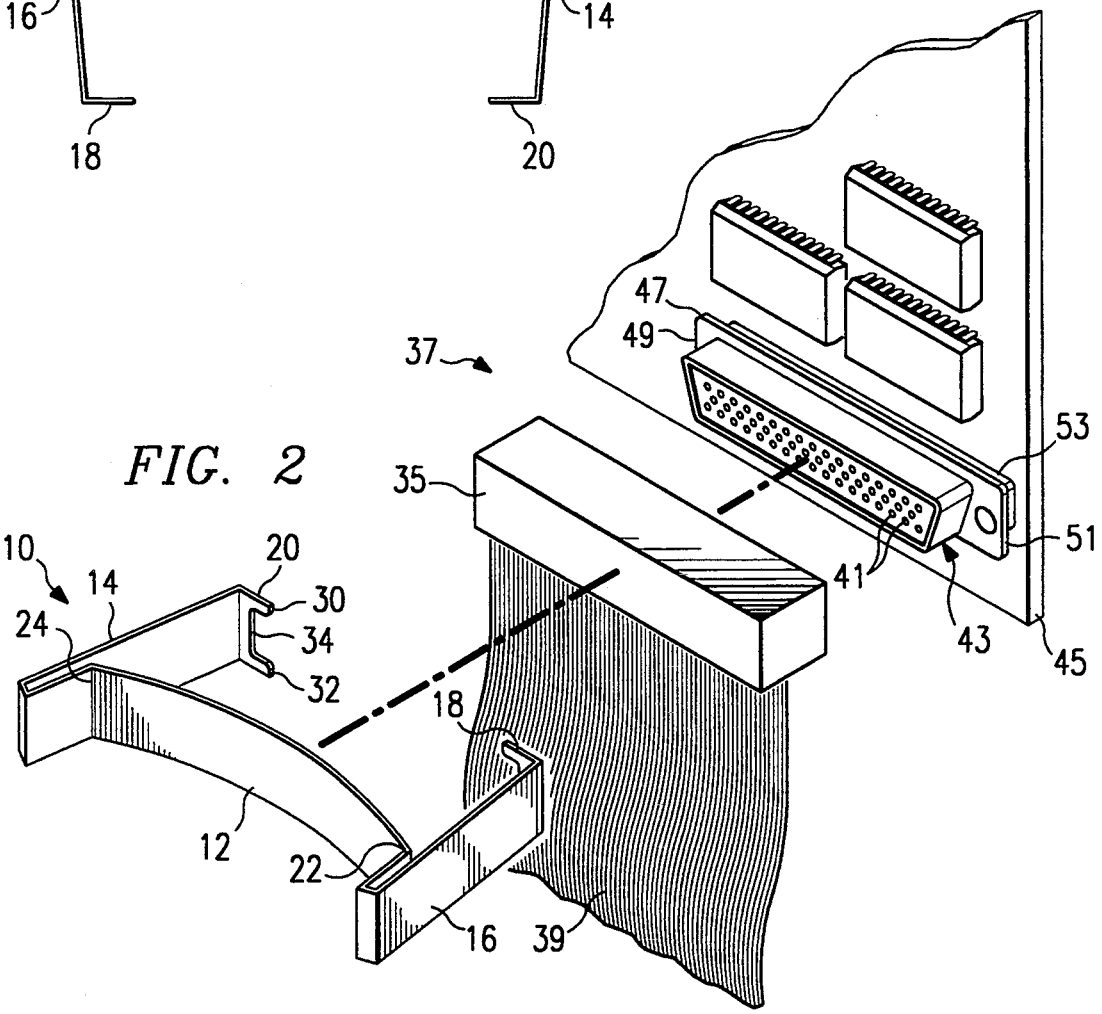
FIG. 2 is an expanded view of the restraining device, the removable connector element and the mounted connector element as mounted on a substrate such as a printed circuit board.

Turning to FIG. 2, it will be noted that the tangs, such as 20, comprise extensions shown as 30 and 32 on either side of a cutout portion 34. Tang 18 is similarly constructed (although not clearly illustrated). The force applying member 12 applies force directly against an upper surface or cover 35 of a removable connector generally designated as 37 which contains male connector elements not shown and is electrically connected to a ribbon cable 39. The male pins of connector 37 engage the female slot connector slots or contacts such as 41 of a connector generally designated as 43 which is mounted on a printed circuit board 45. The connector 43 is compatible with the ribbon connector 37 and the two together form a cable connector. The mounted cable connector 43 includes a base plate 47 which has ends 49 and 51 extending outwardly from a sub-base 53 which contains press fit or solder pins that extend through printed circuit board 45 and are contact connected or soldered to paths on the backside of the printed circuit board 45 in the area of electrical connections which are not shown. However, the pins themselves are designated by example as 55 in FIG. 3.

Figure 3:
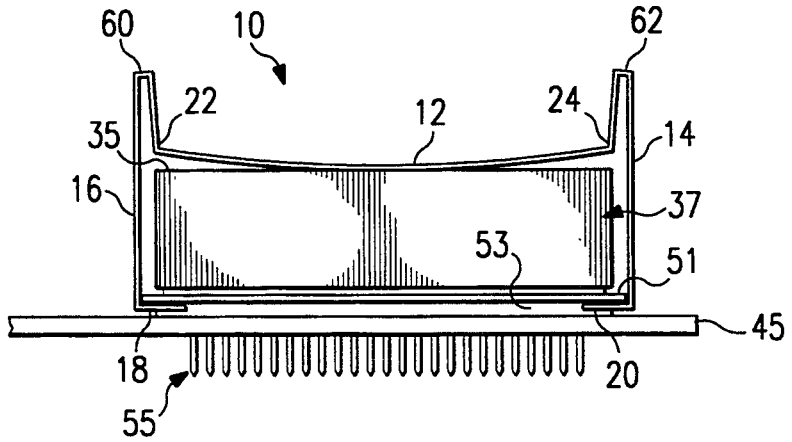
FIG. 3 is a side view of FIG. 2 in the locked or restrained mode.

As will be noted, the designation numbers from FIG. 1 have been carried over where appropriate to FIG. 2 and the numbers from FIG. 2 have been carried over to FIG. 3. In FIG. 3, the upper extensions of leg 16 is given a designation of 60 while the upper extension of leg 14 is given the designation of 62. It will be noted that pressure applied to the portions 60 and 62 in an inward direction will cause the arms 14 and 16 to pivot around pivot points 22 and 24 and cause the tangs 18 and 20 to move in an outwardly direction thereby disengaging the connector restraining device from the two connectors 37 and 43 and thus, allowing the removal of connector block 37 from electrical contact with contacts 41 of mounted connector 43. The relaxed position and shape of the restraining device 10 is shown in FIG. 1. The same forces as required for disengagement can be used in the engagement process to widen the distance between tangs 18 and 20 for locking onto the two connectors when engaged as shown in FIG. 3. It will be noted that a downward pressure also has to be applied to deflect the force applying member 12 which provides the positive engagement between the tangs 18 and 20 and the bottom surface of the extensions of base 51. It is the two opposing forces of force applying member 12 and the tangs 18 and 20 combined with friction that keep the restraining member 10 in place as well as the inward pressure that is applied by the spring-like action or resilience of the restraining apparatus 10 and its desire to return to the dimensions shown in FIG. 1 even though applied in the locked condition of FIG. 3.

While I have disclosed a single embodiment of the inventive concept using a high tension spring-type material with inwardly tanged arms pivoted with respect to a cover pressure means as a connector locking device and locking device which can be easily disengaged by applying a slight inward pressure on an upward extension of the arms while simultaneously applying a slight downward pressure, I wish to be limited only by the scope of the appended claims wherein.

I claim:

1. The method of securing and removing a ribbon cable connector having a cover portion to and from a complementary mounted cable connector having a first and second end and an accessible back portion at each of the first and second ends, comprising the steps of:

clamping the end and back portion of each of the first and second ends of the mounted connector with tangs located at corresponding engagement ends of a pair of spring loaded levers, the spring loaded levers each having an extension located at an operational end opposite the engagement ends and having a pivotal point;

simultaneously pressing against the cover of the ribbon cable connector with a member interconnecting said spring loaded levers substantially at their pivotal points to secure the ribbon cable connector to the complementary mounted cable connector; and subsequently removing the tangs from the end and back portion of each of the first and second ends of the mounted connector by applying a force urging the extensions toward each other.

2. Apparatus for securing a ribbon cable connector having a cover portion to a complementary mounted cable connector having a first and second end and an accessible back portion at the first and second ends comprising, in combination:

a pair of tanged lever means for clamping the respective ends and the back portions of each of the ends of the complementary mounted cable connector wherein the tanged lever means are inwardly tensioned and wherein each of the pair of tanged lever means includes a pivotal point and a pair of inwardly projecting latching extensions at a first end of the corresponding tanged lever means; and cover pressure means for simultaneously pressing against a cover of the ribbon cable connector, said cover pressure means interconnecting said tanged lever means substantially at their pivotal points.

3. Apparatus for securing a cable connector having a top-side cover, to a complementary mounted cable connector having a first and second end and an accessible rear-side portion at each of said first and second ends, comprising, in combination:

inwardly tanged levers, each having a pivotal point, for clamping to said first and second ends of said mounted connector and to said rear-side portions at said first and second ends of said mounted connector, said tanged levers further comprising separation means extending away from said pivotal point such that a force applied to bring said separation means together causes said tanged levers to move apart from said first and second ends of said mounted connector;

cover pressure means for simultaneously pressing against said top-side cover of said cable connector; and tensioning means interconnecting said cover pressure means and the pivotal points of said tanged levers whereby said tanged levers are inwardly tensioned.

4. A connector retention apparatus for coupling a ribbon cable connector to a complementary connector, wherein said complementary connector has a first and second end, each of said ends of said complementary connector having a vertical side, top, and bottom, said connector retention apparatus comprising:

a contact member for coacting with said ribbon cable connector by applying a contact force to said ribbon cable connector toward said complementary connector;

a first force applying member attached at a first pivotal point to said contact member, said first force applying member comprising:

a lever extending in a first direction away from said first pivotal point;

an extension extending in a second direction away from said first pivotal point; and a retention portion substantially perpendicular to said lever of said first force applying member and for coupling to said complementary connector;

a second force applying member attached at a second pivotal point to said contact member, said second force applying member comprising:

a lever extending in a third direction away from said second pivotal point;

an extension extending in a fourth direction away from said second pivotal point; and a retention portion substantially perpendicular to said lever of said second force applying member and for coupling to said complementary connector;

wherein a disengagement force applied to bring said extension of said first force applying member toward said extension of said second force applying member moves said retention portion of said first force applying member away from said retention portion of said second force applying member to disengage said retention portions from said complementary connector; and wherein said retention portion of said second force applying member moves toward said retention portion of said first force applying member by releasing said disengagement force to engage said retention portions to said complementary connector, and wherein each of said retention portions comprises:

an edge for conforming to said vertical side of said complementary connector;

a top extension, connected to said edge, for conforming to said top of said complementary connector; and a bottom extension, connected to said edge, for conforming to said bottom of said complementary connector.

5. The connector restraining apparatus of claim 4 wherein said second direction is linearly opposite said first direction and wherein said fourth direction is linearly opposite said third direction.

6. The connector restraining apparatus of claim 4 wherein said contact member is curved in the direction of said retention portions of said first and second force applying members.

7. The connector restraining apparatus of claim 4 wherein said top and bottom extensions are connected substantially perpendicular to said edge.

8. The connector restraining apparatus of claim 4 wherein said first force applying member further comprises coupling structure connecting an end of said lever, opposite said first pivotal point, to an end of said extension of said first force applying member; and wherein said second force applying member further comprises coupling structure connecting an end of said lever, opposite said second pivotal point, to an end of said second extension of said second force applying member.

* * * * *

UNITED STATES PATENT AND TRADEMARK OFFICE

CERTIFICATE OF CORRECTION

PATENT NO. : 5,364,287

DATED : November 15, 1994

INVENTOR(S) : William F. Weber

It is certified that error appears in the above-indentified patent and that said Letters Patent is hereby corrected as shown below:

Column 3, line 11, after "wherein" delete the period.

Signed and Sealed this

Sixteenth Day of May, 1995

*Attest:*

*Attesting Officer*

Bruce Lehman

BRUCE LEHMAN

*Commissioner of Patents and Trademarks*